United States Patent [19]

Nette

[11] 3,995,781

[45] Dec. 7, 1976

[54] VIBRATORY COMMINUTOR

[76] Inventor: Friedrich Wilhelm Nette, Sachsenstrasse 26, Hosel, Germany

[22] Filed: Jan. 13, 1975

[21] Appl. No.: 540,823

[30] Foreign Application Priority Data

Jan. 11, 1974 Belgium ..... 139711

[52] U.S. Cl. ..... 241/147; 241/164; 241/262

[51] Int. Cl.[2] ..... B02C 1/00

[58] Field of Search ..... 241/139, 147, 153, 156, 241/164, 175, 201, 211, 262, 263, 264, 283, 284; 248/204, 358; 173/139, 162; 267/137

[56] References Cited

UNITED STATES PATENTS

| | | | |
|---|---|---|---|
| 3,154,257 | 10/1964 | Wootten | 241/283 X |
| 3,211,388 | 10/1965 | Gartner | 241/262 X |
| 3,545,688 | 12/1970 | Oshima et al. | 241/175 |
| 3,687,379 | 8/1972 | Nette | 241/262 |

*Primary Examiner*—Granville Y. Custer, Jr.
*Attorney, Agent, or Firm*—Michael J. Striker

[57] ABSTRACT

A plurality of rigid first comminuting elements are located in a container for material to be comminuted, and are stationarily mounted with reference to the container. A plurality of second comminuting elements are also located in the container and each of these confronts at least one of the first elements with spacing from the same. Resiliently yieldable springs mount each of the second elements for swinging movements relative to the first elements, so as to crush material in the gap by cooperation between the first and second elements. A drive is provided for imparting vibratory swinging movements to the second elements.

12 Claims, 5 Drawing Figures

VIBRATORY COMMINUTOR

BACKGROUND OF THE INVENTION

The present invention relates generally to a comminutor, and in particular to a vibratory comminutor.

Still more particularly, the invention relates to a vibratory comminutor having at least one vibratable container with at least one crushing zone in which at least one hammer unit is freely swingably mounted, and this hammer unit is located between sets of anvil units and can have swinging movements imparted to it substantially only in a straight-line direction towards and away from the crushing surfaces of the anvil units.

A vibratory comminutor is known from German Pat. No. 1,926,615 corresponding to U.S. Pat. No. 3,687,739 issued Aug. 29, 1972. This prior-art device has a vibratable container with at least one crushing zone in which a crushing unit is mounted which is freely swingable in a plane. The crushing unit is configurated in form of hammer elements which are each arranged between two parallel fixed anvil members and can move only in a straight line towards and away from the respectively anvil members. In this prior-art construction the hammer elements swing in a horizontal direction. The advantage of this construction is the fact that the hammer elements will perform a predetermined, i.e. directed hammer movement, so that it is assured that they will impinge the contact faces of the anvil elements with the necessary energy required to crush material located in between the hammer and anvil elements. This means that the associated contact faces on a respective hammer element and its cooperative anvil element cannot shift relative to one another, and this in turn assures that the rapidly swinging hammer elements will properly engage and comminute the material in cooperation with the associated anvil elements. Since the hammer elements perform precisely directed movements, it is assured that the energy required to produce the desired swinging movements will in fact be largely employed for the actual comminuting of the material, so that it has been observed that this prior-art construction has an efficiency which is greater than that of other prior-art vibratory comminutors by approximately 30–60 percent. This, in turn, quite evidently reduces the expenses involved for the crushing of the material, for example on a per ton basis. This prior-art comminutor, which I have disclosed in German Pat. No. 1,926,615 corresponding to U.S. Pat. No. 3,687,379, can be used with good effect in substantially all branches of industry, and has been found to be especially advantageous in the cement producing industry.

In my prior-art construction the guidance of the swingably mounted hammer elements is effected by turnably mounted tubes which are located at the upper sides and undersides of the hammer elements, and if necessary also on both side faces. These tubes can be mounted for low friction in anti-friction bearings.

However, I have found that it is desirable to still further improve the guidance of the hammer elements and to increase the force with which the hammer elements impinge the associated anvil elements, in order to further improve the efficiency of the comminutor and to increase the period of operation for which the comminutor can operate without requiring repairs or maintenance.

SUMMARY OF THE INVENTION

Accordingly, it is a general object of this invention to provide an improved vibratory comminutor of the type described above, but which includes the improvements set forth in the preceding paragraph.

In keeping with this and other objects which will become apparent hereafter, one feature of the invention resides in a vibratory comminutor that, briefly stated, comprises a container for material to be comminuted, a plurality of stationarily mounted rigid first comminuting elements located in the container, and a plurality of second comminuting elements also located in the container and each confronting at least one of the first elements with spacing therefrom. Resiliently yieldable mounting means mounts each of the second elements for swinging movements relative to the first elements, so as to crush material in the gap by cooperation between the first and second elements. Drive means is provided for imparting the aforementioned vibratory swinging movements to the second elements.

My objects are achieved by having the mounting means in form of spring elements which mount the second comminuting elements and are themselves only supported on fixed supports. The second comminuting elements may, incidentally, each be composed of a plurality of individual sections, in which case each of these sections will be so mounted.

It is advantageous if it is the container which has vibrations transmitted to it, as is in fact the case in my aforementioned prior-art comminutor also. These oscillations or vibrations are transmitted via the fixed supports and the spring elements to the second comminuting elements, so that the latter perform vibratory swinging movements in direction towards and away from the associated anvil elements, without requiring any other type of mounting or guidance for the hammer elements. This eliminates wear and tear on such separate guides, as well as obviating any repairs or maintenance, for example of guide tubes as was required in my prior-art construction. Moreover, no antifriction bearings are involved in guiding the movements of the hammer elements, so that the total construction of my novel vibratory comminutor is simpler than before, and therefore also less expensive. The spring elements which mount the hammer elements, i.e. the second comminuting elements, can be readily so constructed and arranged that they are capable of undergoing an extremely large number of flexures without being subjected to material fatigue. If, however, for any reason it is necessary to replace one of the spring elements with another one, then such a spring element is less expensive than a guide tube and/or antifriction bearing that would otherwise have to be provided in its place, and therefore the maintenance of my novel vibratory comminutor is also less costly than my prior-art comminutor.

Each of the hammer elements in the present invention has separate spring elements associated with it. This has the advantage that the hammer elements are equally well guided at the center as well as the marginal regions, whereas I have observed in my prior-art construction that the guide tube had a tendency to flex or bend in its center region.

According to an advantageous embodiment of the invention the spring elements engage both the underside and the upper side of each hammer element, whereby an especially reliable guidance of the respective hammer element is assured.

A further advantageous embodiment of the invention is characterized in that the spring elements are arranged at the upper side and under dide of the respective hammer element to extend in the direction of elongation of the hammer element, being located on the longitudinal center line of the same at substantial spacing from one another and extending in parallelism with one another.

According to a further embodiment of the invention I propose that a spring element located beneath the associated hammer element be arranged coaxially with respect to another spring element which is located above the same hammer element.

I may also provide an embodiment in which both the underside and the under side of each hammer element have two spring elements associated with them. This assures, as seen with respect to the length of each hammer element, that the forces which develop and the weight of the respective hammer element are not only absorbed relatively uniformly by the spring elements, but that the energy-storing capability of the spring elements increases the force of the blows transmitted by the hammer elements to the associated anvil elements.

It is also possible to have two spring elements act upon one side of the respective hammer element, i.e. the underside or the upper side thereof, and to have only a single spring element act upon the opposite side, i.e. the underside or the under side of the hammer element. In this case the single spring element advantageously acts upon the hammer element in a region located intermediate the other two spring elements.

According to a particularly advantageous embodiment of the invention the spring elements are mounted in a prestressed condition intermediate their supports or abutments and the associated hammer element. The spring elements may be constructed of such length that during their deflection out of a vertical plane in response to the performance of oscillatory movements of the associated hammer element, the spring elements will follow the hammer element so that the latter will in effect be incapable of performing any pendulum movements during the vibration, but will be forced to travel in a horizontal plane towards and away from the contact faces of the associated anvil element or elements, so that the contact faces on the anvil element or elements and on the hammer element will engage one another in surface-to-surface contact, which results in an improvement of the crushing or comminuting effect. Moreover, if there is large-area surface-to-surface contact of this type, the wear of the contacting surfaces will be correspondingly lower than would otherwise be the case.

According to one embodiment of the invention the spring elements may be constructed as helical expansion springs. Such expansion springs are usually made of spring steel. However, I also wish to include the possibility that two or more springs may be nested within one another. Furthermore, the inventive concept includes spring elements wherein (as seen in a lateral projection) the springs do not outline a rectangle, but instead are for example of trapezoidal or cylindrical configuration. The spring steel used for producing the springs need not be of circular cross section, but instead the cross section can be varied in dependence upon the particular requirements of a given situation, for example it may be quadratic, rectangular or trapezoidal.

In some instances it may be advantageous if each spring element is of a synthetic plastic material having the necessary springy characteristics and being resistant to aging. For example, an appropriate polyvinyl chloride or polyurethane may be used for this purpose. If a polyurethane is used, it will advantageously be a type having an appropriately high degree of Shore hardness and a high bounce-back elasticity. In case of heavy duty applications, the spring elements may include polyurethane blocks which have been once subjected to such high stressing at least in the direction of the longitudinal axis, i.e. in the direction of their spring axis, by being subjected to high pressure, thay any possible residual plastic deformation of such blocks is eliminated. This means that such blocks will always resiliently return to their starting position even under high-stress applications, so that their spring characteristics are analogous and in fact substantially the same as those found in spring elements consisting of steel.

The spring elements may also be in form of rubber blocks, which may be embedded between suitable metallic plates, for example by being adhesively bonded to them, analogous for instance to motor mounts used in automobiles.

It is also conceivable to use spring elements which are configurated as strips of sheet material. In such cases, the hammer element in question can be suspended from such a strip and/or be supported thereon, so that it can oscillate in the required manner when the container is vibrated.

A secure mounting of the spring elements is obtained in that the mounting locations for each spring element are formed by depressions provided in the hammer elements and the supports, in which depressions the spring elements are engaged. It is however possible to additionally secure the ends of the spring elements against movement out of these depressions, for example by means of pins, screws, splints or other devices, although it is not anticipated that a need for such additional securing devices would arise since the spring elements will be mounted in prestressed condition and therefore not be likely to jump out of their respective recesses.

If the movements of the hammer elements are to be essentially in a straight line, that is if the path of movement is to be curved only so slightly as to be barely visible, then the associated contact faces of the hammer elements and the anvil elements may also be inclined in accordance with this curvature, to again assure that they will always move only into surface-to-surface contact to reduce wear and tear and improve the crushing of material.

Although embodiments in which the spring elements cooperate with the undersides and the under sides of the hammer elements, or of the individual sections thereof, offer particular advantages in practical application, it is nevertheless possible to arrange these spring elements (or additional ones) in such a manner that their longitudinal axes face in the direction of either the transverse or longitudinal axes of the hammer elements or the individual sections thereof, or at least face substantailly in the direction of the transverse or longitudinal axes. In such embodiments the hammer elements or their individual sections may be provided with appropriate projections, abutments or shoulders, which are engaged by the spring elements whose opposite ends then engage at a diametrally opposite location a respective fixed abutment associated with an anvil element, for example again in form of abutments, projections or shoulders on the anvil elements. In such arrangements the vibration of the container would alternately cause compression and relaxation of the spring elements. In order to obtain an extremely finely crushed product, it is possible to shift in the container during the comminuting operation.

An advantageous embodiment of the invention proposes that a screen or sieve be located in each comminuting zone between the anvil elements, although of course more than one such screen or sieve can be utilized. In any case, the mesh of such screen or sieve should be arranged to permit the passage therethrough only of particles having the desired final particle size, and such material may be then withdrawn by suction from the respective screen or sieve. These latter can be so constructed that they extend in vertical direction through all or some of the comminuting zones. At at least one side of the comminuting zones the screens may be provided in such a way that they form with the wall or walls of the container a channel that extends substantially in a vertical plane and which is connected to at least one vacuum pump.

Since the screens or sieves that are used for this purpose are as a rule of very fine-mesh construction, there is some danger that they might be damaged by the suction applied for withdrawing the material. Therefore it is further proposed that the screens be laterally supported by thicker apertured plates, by rods, by grids or the like.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
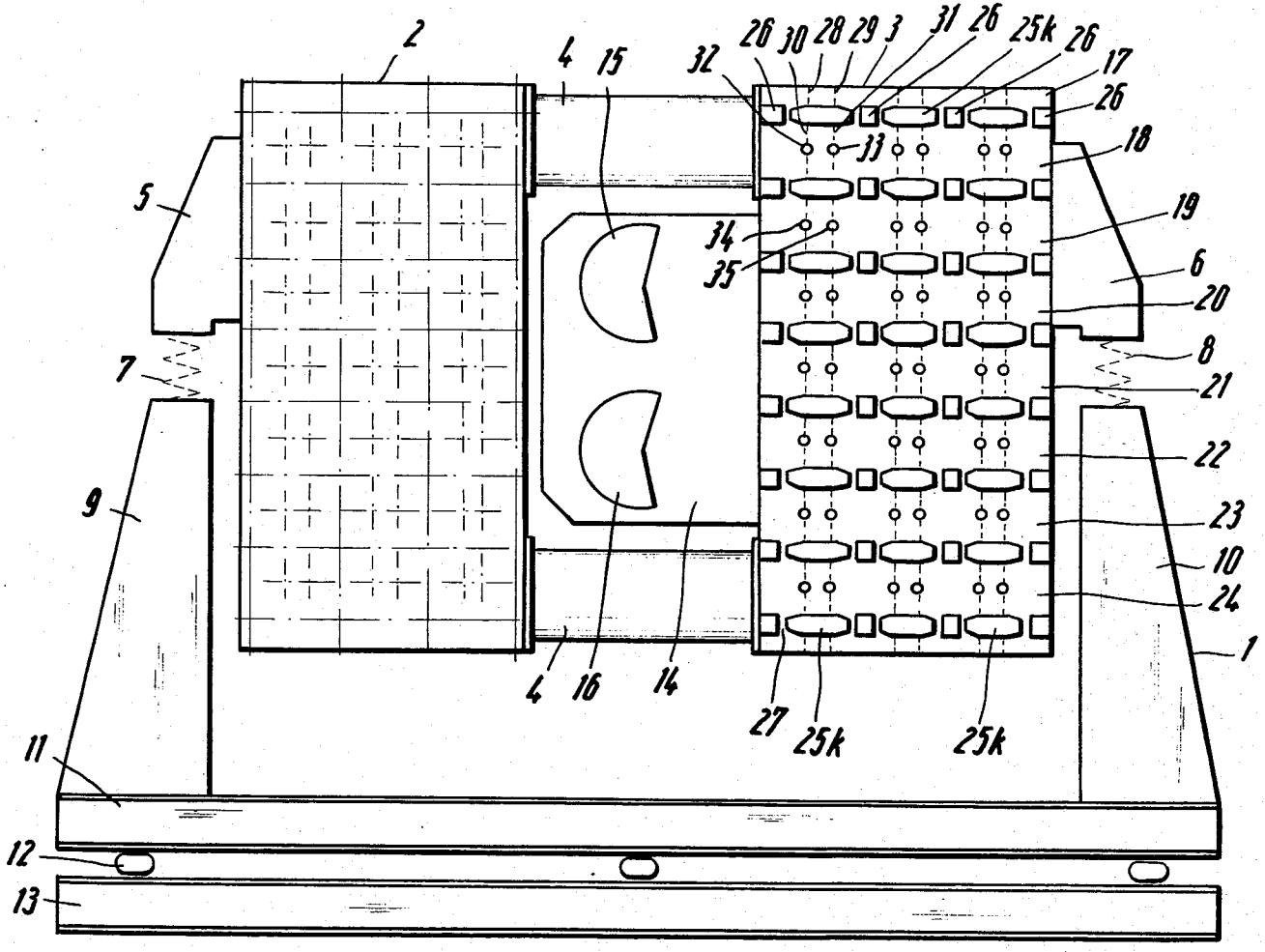
FIG. 1 is a side view, partly sectioned, illustrating an embodiment of the invention.

The invention is illustrated on hand of a vibratory comminutor that is especially suitalbe for use in the cement producing industry. It is, however, not limited thereto. The illustrations are diagrammatic, but are sufficiently clear for an understanding of the invention. It will be appreciated that a vibratory comminutor according to the present invention can be used with great advantages for comminuting of sand, fire clay, ores, limestone, coals, chemicals, slag, quartzite, abrasives and the like. Because of the high degree of efficiency of the comminutor according to the present invention, the latter can also be constructed on a very small scale, for example for laboratory purposes, and can then be used in the pharmacetuical industry, or for similar applications, that is to produce tablets or the like. The present invention incorporates the substantial advantage that was already disclosed in my prior German patent and is mentioned in the introductory portion of this specification, namely the fact that the rapidly oscillating hammer elements, which may perform a large number of impacts per minute upon the associated anvil elements, produce not only an excellent crushing of the material, but also a mixing of the material that is admitted into the container. Because of this the novel vibratory comminutor can advantgeously also be used in the chemical industry, for example in the manufacture of synthetic plastic materials, and in the paint and dye industry, for example for comminuting dyestuffs and similar matter. A further advantageous feature of the vibratory comminutor according to the present invention is the fact that it operates with considerably less noise than the one which I have disclosed in my aforementioned German patent, since the hammer elements or their individual sections are no longer mounted on fixed supports, but are connected with fixed supports only via the spring elements. This reduces the noise of operation of the novel comminutor, and therefore has a beneficial influence upon the environment.

Discussing now the embodiment in FIGS. 1–5 in detail, it will be seen that reference numeral 1 identifies a frame or support of the novel comminutor. Reference numerals 2 and 3 identify two containers (also one, or more than two, could be used) which are of approximately rectangular cross section in the illustrated embodiment. The containers 2 and 3 are connected by a steel construction 4, and are mounted via mounts 5 and 6 on consoles 9 and 10 of the frame 1. Vibration damping elements 7 and 8, such as springs, are interposed. The consoles themselves are supported on steel rails 11 and are fixedly connected with the same. The steel rails 11 are mounted via further vibration damping elements 12 on base supports 13 so that the vibrations emanating from the comminutor during its operation will hardly be transmitted to the surrounding ground. This eliminates the possibility that a structure, such as a building or its foundation might be damaged. A driven imbalance-type arrangement 14 with imbalanced masses 15 and 16 is mounted between the containers 2 and 3 and serves to simultaneously and synchronously vibrate or oscillate the containers 2 and 3.

In the illustrated embodiment, the longitudinal axes of the containers 2 and 3 have a vertical orientation and extend in parallelism with one another, so that the material to be crushed and that is admitted at the upper sides of the containers, for example via a feed hopper 44 that may be located in the space between the containers 2 and 3, can flow under the influence of gravity to the outlet 45 which is also advantageously located intermediate the containers 2 and 3. Of course, more than a single inlet and more than a single outlet may be provided, for example one for each container 2 and 3. The inlet or inlets may have associated with them respective metering devices which distribute the material to the individual containers. The arrangement may also be such that the different containers 2, and 3 receive material of different types or characteristic and/or different particle size. It is quite evident that it is possible to comminute material to one particle size in one of the containers, and at the same time to comminute material to a different particle size in the other container.

Figure 3:
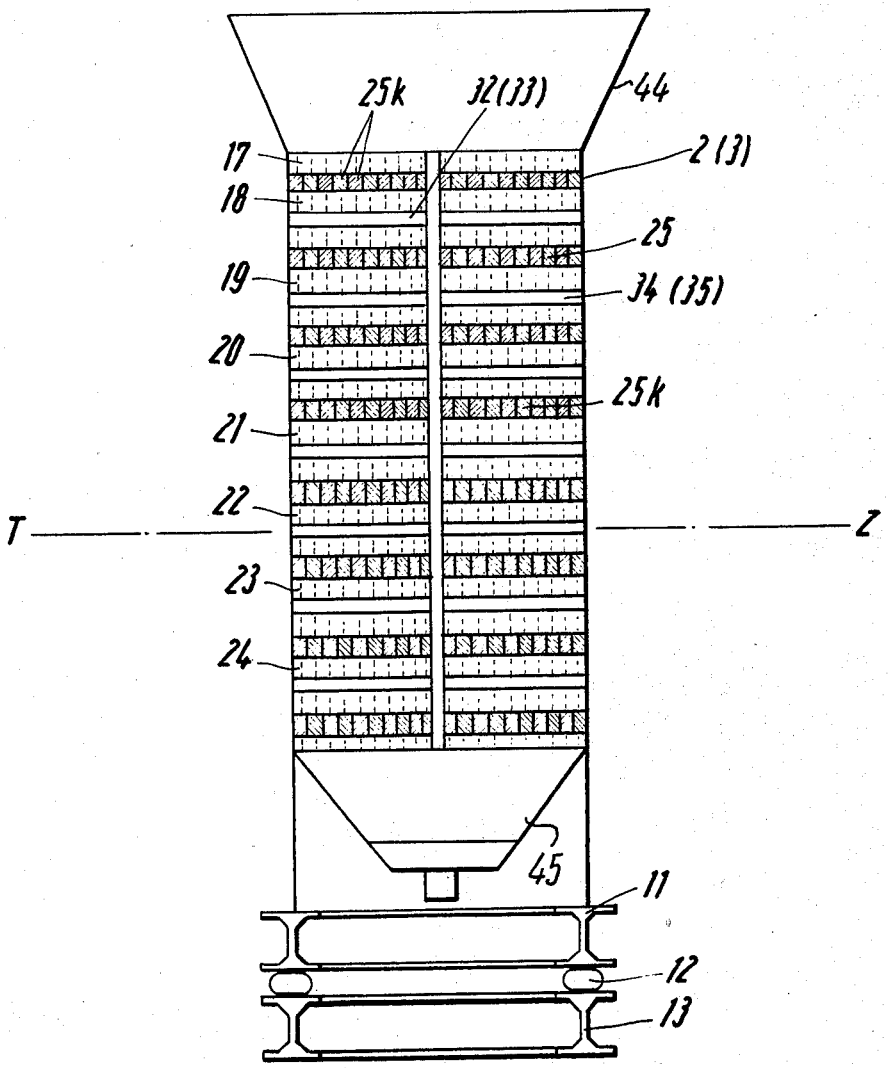
FIG. 3 is a partly sectioned end view of a detail of the embodiment in FIGS. 1 and 2.

FIGS. 1 and 3 indicate particularly clearly that there are provided a plurality of vertically superposed comminuting zones 17–24 which have relatively significant spacing between them. The comminuting zones 17–24 each have associated with them comminuting devices which in the illustrated embodiment are composed of a plurality of hammer elements 25 and their associated anvil elements 26.

FIG. 3 shows especially clearly that in each of the zones 17–24 the hammer elements 25 are subdivided into individual discrete sections 25k in direction transversely to their longitudinal axis T–Z. These sections 25k are arranged with spacing from one another and approximately parallel to each other. FIG. 1 shows that additionally each of the zones 17–24 has arranged therein several (in the illustrated embodiment three) such rows of individual sections 25k in respective horizontal planes and with spacing from one another. Located between the individual rows of sections 25k are anvil elements 26 which are arranged in such a manner that at opposite sides of each hammer element 25 or each row of individual hammer element sections 25k, a gap 27 remains between the respective anvil elements 26 and the associated hammer element 25 or hammer element sections 25k. It is important that the width of the gap 27 be selected for optimum results, which depends upon the amplitude of the movement of the hammer elements 25 or hammer element sections 25k, and upon the character of the material to be comminuted. The gap width can be adjusted in accordance with the particular requirements, simply by appropriate shifting of the hammer elements and/or the anvil elements.

Figure 2:
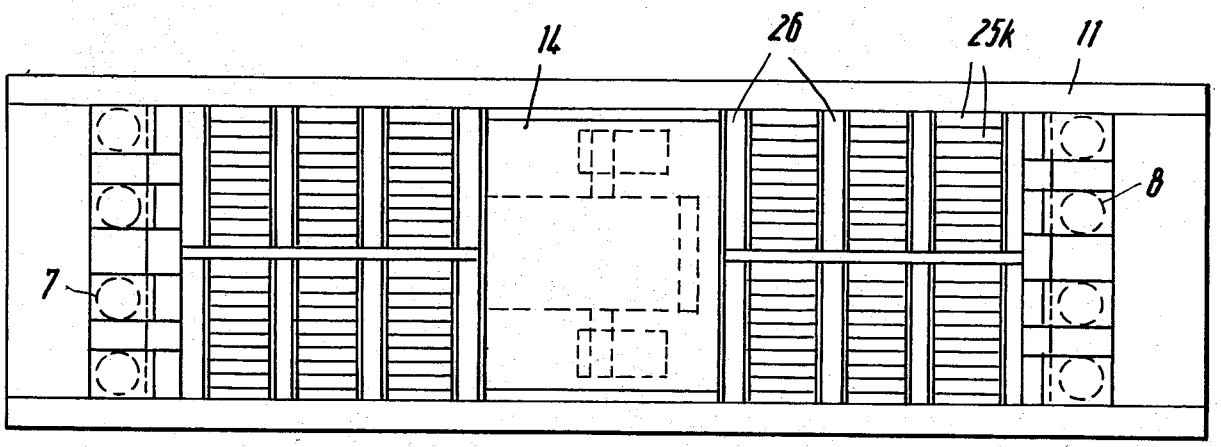
FIG. 2 is a top plan view, partly in section, of the embodiment in FIG. 1.
Figure 4:
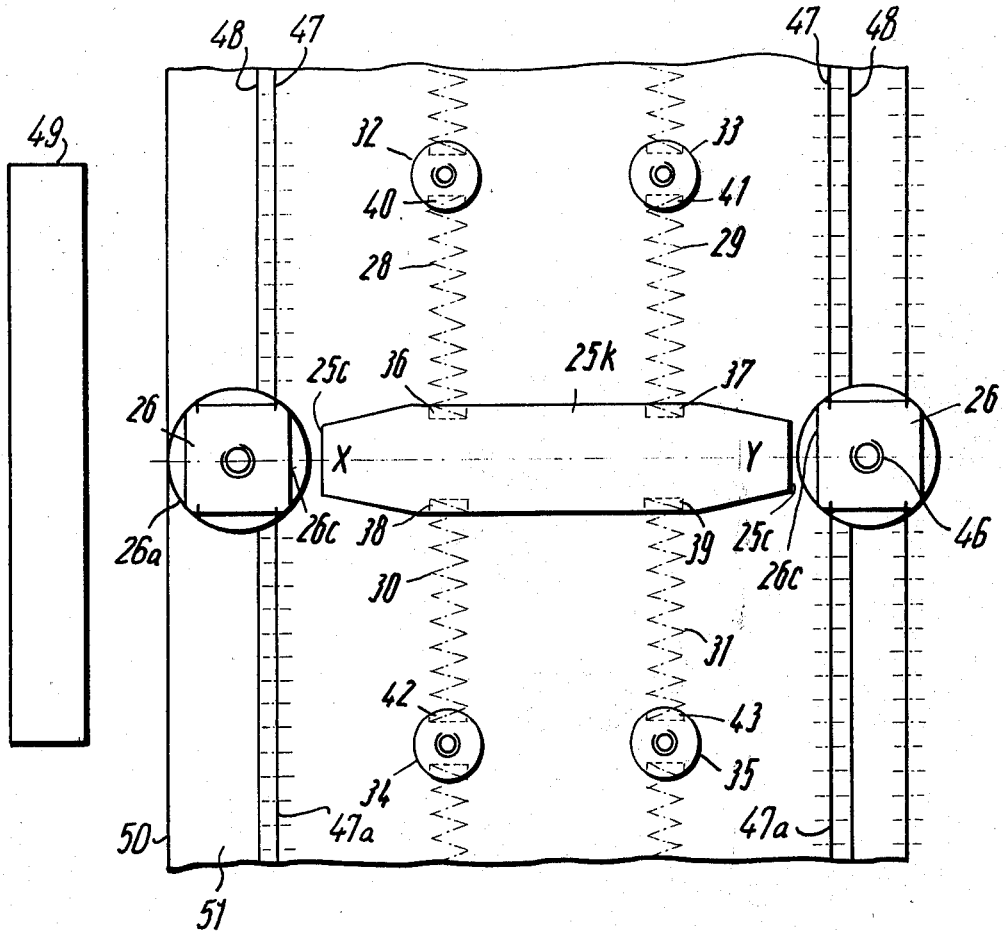
FIG. 4 is a diagrammatic view, on an enlarged scale, showing a detail from a comminuting zone of the embodiment in FIGS. 1–3.
Figure 5:
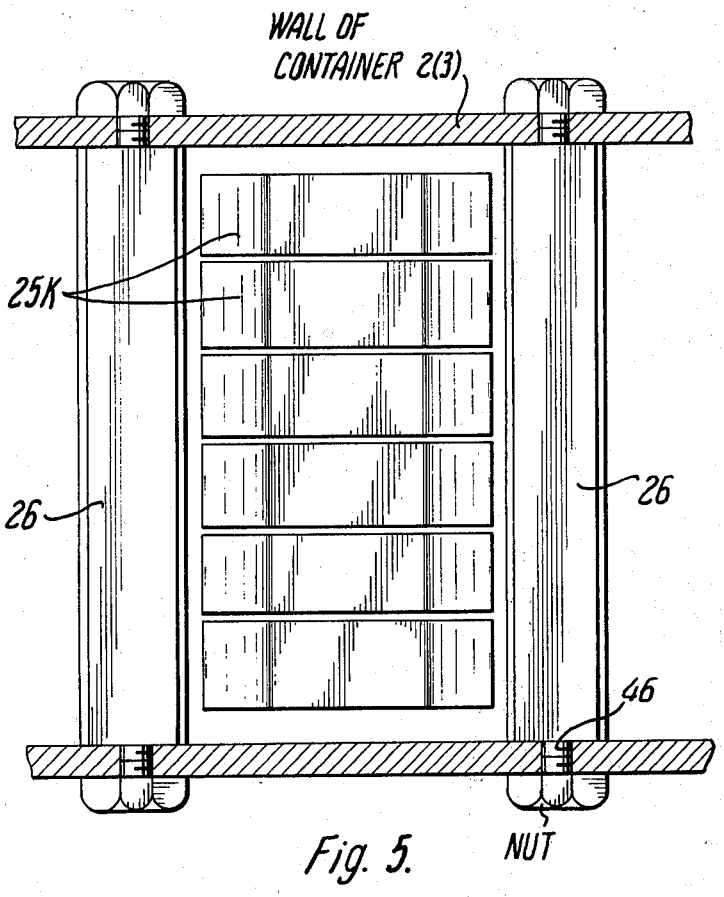
FIG. 5 is a top view of the embodiment of FIGS. 1–4 showing a further detail thereof.

It is clear from FIGS. 2, 4 and 5 taht the anvil elements 26 each extend transversely of the respectively associated container 2, 3. FIGS. 4 and 5 also show that they are each firmly and fixedly connected with the wall of the respective container 2, 3 via screws or bolts 46 secured by nuts, that is, the conection is such that the anvil elements 26 are, releasable. Furthermore, the anvil elements 26 are connected to the walls of the containers 2, 3 in such a manner that they cannot turn. For this purpose the anvil elements are provided with projections at their ends which are not illustrated in detail, but each of these projections extends through a correspondly configurated cutout in the wall of the respective container 2 or 3. In this region pins may be provided which extend into appropriate bores of these projections to prevent the turning of the anvil elements 26 about their longitudinal axes. The arrangement is such that each projection is dust-tightly received in its associated cutout in the wall of the container 2 or 3, and it should be understood quite generally that the containers 2 and 3 are completely dust tight so as to prevent the escape of dust to the exterior. The containers 2 and 3 or the entire comminutor may be accommodated in a further housing or the like which has an acoustically damping characteristic, for example in a room which is lined with acoustically damping material, so as to reduce the transmission of noise to the ambient regions.

In the embodiment illustrated in the drawing, the hammer elements 25 as well as the anvil elements 26 are of steel, especially of hardened steel. If, as in the illustrated embodiment, the hammer elements 25 are subdivided into individual hammer element sections 25k, those regions of the sections 25 which face the anvil elements 26 may be inclined in an outwardly tapering conical manner.

The contact faces 25c of the hammer elements 25 or hammer element sections 25k, which face the cooperating contact faces 26c of the anvil elements 26, are advantageously subjected to a special treatment--such as grinding or the like--so that they will always be in full surface-to-surface contact with the corresponding contact faces 26*c* when they impact the same. Such special treatment should, of course, also be given the contact faces 26*c* for the same reasons.

The anvil elements 26 may be provided, at least at the upper marginal regions which face the inclined regions of the hammer elements 25 or the hammer element sections 25k, with inclined faces 26*a* so that the inclinations on the elements 25 and 26 are located approximately the same level. This assures that the material to be comminuted and which is admitted from above into the containers 2 and 3, is readily guided into the gaps 27.

FIG. 4 shows especially clearly that in the illustrated embodiment each of the hammer element sections 25k is swingably mounted for swingable vibratory or oscillatory displacement in the direction of its longitudinal axis X–Y by means of spring elements 28, 29 and 30, 31. In the illustrated embodiment, each of the hammer element sections 25k has associsted with it two springs that cooperate with its upper side and two springs that cooperate with its lower side. These spring elements are shown by way of example as helical expansion springs which are mounted in a prestressed condition between the hammer element sections 25k and associated fixed abutments or supports 32, 33 and 34, 35. For this purpose, the hammer element sections 25k are formed with depressions or the like that are identified with reference numerals 36, 37 and 38, 39, and into which the ends of the associated spring elements 28–31 are engaged. The depressions or the like could be constructed as blind bores. At their opposite ends the spring elements 28–31 extend into corresponding depressions 40, 41 or 42, 43. The fixed abutments 32–35 are configurated as rods which extend transversely through the respective container 2 or 3 (compare FIG. 3) and which are connected with the walls of the containers in appropriate manner so as to be rigid but nevertheless removable therefrom. In FIGS. 1 and 3 the spring elements 28–31 are diagrammatically illustrated by broken lines.

When the arrangement 14 is driven, the containers 2 and 3 oscillate, and the oscillations are transmitted to the hammer element sections 25k, causing these sections to oscillate and to alternately impinge upon the associated anvil elements 26, thereby crushing or comminuting the material in the container in the respective gaps 27 by impingement of the contact faces 25*c* and 26*c*. The operation continues until the material has been comminuted to the desired particle size.

FIG. 4 shows that screen or sieves 47 provided with apertures 47*a* are located in each of the comminuting zones 17–24 between the anvil elements 26. The sieves 47 extend in vertical direction. The mesh of the sieves 47, that is, the sizes of the apertures 47*a*, should be such as to permit passage therethrough only of particles having the desired final particle size. Such particles may be conveyed away from the sieves 47 by means of a suction-generating device 49, e.g., a vacuum pump. In the illustrated embodiment, the left-hand (as seen in FIG. 4) sieves 47 define a channel 51 with the wall 50 of the container 2 or 3, the channel 51 extending substantially in a vertical direction and being connected with the suction-generating device 49. Since the sieves 47 will usually be of a fine-mesh construction and, hence, might be damaged be of a fine-mesh construction and, hence, might be damaged by the suction which is applied for withdrawing the comminuted material from the containers 2, 3, it is proposed to laterally support the sieves 47 via suitable supporting elements 48 such as, for example, apertured plates, rods, grids or the like.

The various characteristics disclosed herein can be varied without departing from the intent of the present invention. The spring elements should, as a rule, have a spring characteristic of such type that their inherent vibration in operating conditions does not cause resonance, that is that there is no synchronous oscillation obtained with the oscillations of the housing, in order to prevent yielding or possibly even a coming to a halt of the hammer elements during the operation of the comminutor.

It will be understood that each of the elements described above, or two or more together, may also find a useful application in other types of constructions diiffering from the type described above.

While the invention has been illustrated and described as embodied in a vibratory comminutor, it is not intended to be limited to the details shown since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or speciific aspects of this invention.

What is claimed as new and desired to be protected by Letters Patent is set forth in the appended claims:

1. A vibratory comminutor, comprising a container for material to be comminuted, said container including a plurality of vertically spaced comminuting zones; a plurality of first comminuting elements rigidly mounted in said container and arranged so that at least one of said first comminuting elements is located in each of said comminuting zones; a plurality of second comminuting elements movably mounted in said container and arranged so that at least one of said second comminuting elements is located in each of said comminuting zones and confronts a respective one of said first comminuting elements, said second comminuting elements each having an upper side and a lower side, and said second comminuting elements being elongated and each having a longitudinal center line, said second comminuting elements having a rest position and another position in which said second comminuting elements cooperate with the respective first comminuting elements to comminute material; means for vibrating said second comminuting elements; and resiliently yieldable mounting means engaging said second comminuting elements and mounting the latter for movement relative to the respective first comminuting elements in such a manner that, when said vibrating means is operative, the motion of said second comminuting elements is essentially linear and essentially follows the path on which the respective rest position and other position are located, said mounting means comprising spring means engaging said upper side and said lower side of each of said second comminuting elements, and said spring means including, for each second comminuting element, a set of springs having a first plurality of springs which engage the upper side and a second plurality of springs which engage the lower side thereof, the springs of each plurality engaging said second comminuting elements on said center lines and being spaced from one another lengthwise of said center lines.

2. A comminutor as defined in claim 1, wherein each plurality comprises two springs.

3. A vibratory comminutor, comprising a container for material to be comminuted, said container including a plurality of vertically spaced comminuting zones; a plurality of first comminuting elements rigidly mounted in said container and arranged so that at least one of said first comminuting elements is located in each of said comminuting zones; a plurality of second comminuting elements movably mounted in said container and arranged so that at least one of said second comminuting elements is located in each of said comminuting zones and confronts a respective one of said first comminuting elements, said second comminuting elements each having an upper side and a lower side, and said second comminuting elements having a rest position and another position in which said second comminuting elements cooperate with the respective first comminuting elements to comminute material; means for vibrating said second comminuting elements; and resiliently yieldable mounting means engaging said second comminuting elements and mounting the latter for movement relative to the respective first comminuting elements in such a manner that, when said vibrating means is operative, the motion of said second comminuting elements is essentially linear and essentially follows the path on which the respective rest position and other position are located, said mounting means comprising spring means engaging said upper side and said lower side of each of said second comminuting elements, and each spring of said spring means which engages one of said lower sides being coaxial with a spring which engages the respective upper side.

4. A vibratory comminutor, comprising a container for material to be comminuted, said container including a plurality of vertically spaced comminuting zones; a plurality of first comminuting elements rigidly mounted in said container and arranged so that at least one of said first comminuting elements is located in each of said comminuting zones; a plurality of second comminuting elements movably mounted in said container and arranged so that at least one of said second comminuting elements is located in each of said comminuting zones and confronts a respective one of said first comminuting elements, said second comminuting elements each having an upper side and a lower side, and said second comminuting elements having a rest position and another position in which said second comminuting elements cooperate with the respective first comminuting elements to comminute material; means for vibrating said second comminuting elements; and resiliently yieldable mounting means engaging said second comminuting elements and mounting the latter for movement relative to the respective first comminuting elements in such a manner that, when said vibrating means is operative, the motion of said second comminuting elements is essentially linear and essentially follows the path on which the respective rest position and other position are located, said mounting means comprising spring means engaging said upper side and said lower side of each of said second comminuting elements, and said spring means including a set of springs for each of said comminuting elements, each of springs having two spaced springs which engage one of said sides of the respective second comminuting element and one spring which engages the other of said sides of the same comminuting element intermediate the respective two spaced springs.

5. A vibratory comminutor, comprising a container for material to be comminuted, said container including a plurality of vertically spaced comminuting zones; a plurality of first comminuting elements rigidly mounted in said container and arranged so that at least one of said first comminuting elements is located in each of said comminuting zones; a plurality of second comminuting elements movably mounted in said container and arranged so that at least one of said second comminuting elements is located in each of said comminuting zones and confronts a respective one of said first comminuting elements, said second comminuting elements each having an upper side and a lower side, and said second comminuting elements having a rest position and another position in which said second comminuting elements cooperate with the respective first comminuting elements to comminute material; means for vibrating said second comminuting elements; abutment means on said container adjacent said second comminuting elements; and resiliently yieldable mounting means engaging said second comminuting elements and mounting the latter for movement relative to the respective first comminuting elements in such a manner that, when said vibrating means is operative, the motion of said second comminuting elements is essentially linear and essentially follows the path on which the respective rest position and other position are located, said mounting means comprising spring means engaging said upper side and said lower side of each of said second comminuting elements, and said spring means being mounted in prestressed condition intermediate said abutment means and the respective second comminuting elements.

6. A vibratory comminutor, comprising a container for material to be comminuted, said container including a plurality of vertically spaced comminuting zones; a plurality of first comminuting elements rigidly mounted in said container and arranged so that at least one of said first comminuting elements is located in each of said comminuting zones; a plurality of second comminuting elements movably mounted in said container and arranged so that at least one of said second comminuting elements is located in each of said comminuting zones and confronts a respective one of said first comminuting elements, said second comminuting elements each having an upper side and a lower side, and said second comminuting elements having a rest position and another position in which said second comminuting elements cooperate with the respective first comminuting elements to comminute material; means for vibrating said second comminuting elements; and resiliently yieldable mounting means engaging said second comminuting elements and mounting the latter for movement realtive to the respective first comminuting elements in such a manner that, when said vibrating means is operative, the motion of said second comminuting elements is essentially linear and essentially follows the path on which the respective rest position and other position are located, said mounting means comprising spring means engaging said upper side and said lower side of each of said second comminuting elements, and said spring means including helical expansion springs.

7. A vibratory comminutor, comprising a container for material to be comminuted, said container including a plurality of vertically spaced comminuting zones; a plurality of first comminuting elements rigidly mounted in said container and arranged so that at least one of said first comminuting elements is located in each of said comminuting zones; a plurality of second comminuting elements movably mounted in said container and arranged so that at least one of said second comminuting elements is located in each of said comminuting zones and confronts a respective one of said first comminuting elements, said second comminuting elements each having an upper side and a lower side, and said second comminuting elements having a rest position and another position in which said second comminuting elements cooperate with the respective first comminuting elements to comminute material means for vibrating said second comminuting elements; abutment means on said container adjacent said second comminuting elements; and resiliently yieldable mounting means engaging said second comminuting elements and mounting the latter for movement relative to the respective first comminuting elements in such a manner that, when said vibrating means is operative, the motion of said second comminuting elements is essentially linear and essentially follows the path on which the respective rest position and other position are located, said mounting means comprising spring means engaging said upper side and said lower side of each of said second comminuting elements, and said abutment means and said second comminuting elements being formed with recessed seats which are engaged by said spring means.

8. A comminutor as defined in claim 7, wherein said screen extends in a substantially vertical plane in said zones; and further comprising suction means for drawing the comminuted material having said predetermined particle size, laterally through said screen.

9. A comminutor as defined in claim 7, and further comprising supporting elements for supporting said screen.

10. A comminutor as defined in claim 7, wherein said container has a wall and said screen defines a passage with said wall and further comprising a source of suction communicating with said passage for drawing particles having said predetermined particle size through said screen into said passage and along the latter.

11. A vibratory comminutor, comprising a container for material to be comminuted, said container including a plurality of vertically spaced comminuting zones; a plurality of first comminuting elements rigidly mounted in said container and arranged so that at least one of said first comminuting elements is located in each of said comminuting zones; a plurality of second comminuting elements movably mounted in said container and arranged so that at least one of said second comminuting elements is located in each of said comminuting zones and confronts a respective one of said first comminuting elements, said second comminuting elements having a rest position and another position in which said second comminuting elements cooperate with the respective first comminuting elements to comminute material; means for vibrating said second comminuting elements; resiliently yieldable mounting means engaging said second comminuting elements and mounting the latter for movement relative to the respective first comminuting elements in such a manner that, when said vibrating means is operative, the motion of said second comminuting elements is essentially linear and essentially follows the path on which the respective rest position and other position are located; and at least one screen at a level below said comminuting elements in said zones and having a mesh size dimensioned to permit passage only of comminuted material of a predetermined particle size.

12. A vibratory comminutor, comprising a container for material to be comminuted, said container including a plurality of vertically spaced comminuting zones; a plurality of first comminuting elements rigidly mounted in said container and arranged so that at least one of said first comminuting elements is located in each of said comminuting zones; a plurality of second comminuting elements movably mounted in said container and arranged so that at least one of said second comminuting elements is located in each of said comminuting zones and confronts a respective one of said first comminuting elements, said second comminuting elements each having an upper side and a lower side, and said second comminuting elements having a rest position and another position in which said second comminuting elements cooperate with the respective first comminuting elements to comminute material; means for vibrating said second comminuting elements; abutment means on said container adjacent said second comminuting elements; and resiliently yieldable mounting means engaging said second comminuting elements and mounting the latter for movement relative to the respective first comminuting elements in such a manner that, when said vibrating means is operative, the motion of said second comminuting elements is essentially linnear and essentially follows the path on which the respective rest position and other position are located, said mounting means comprising resilient means engaging said upper side and said lower side of each of said second comminuting elements, and said abutment means and said second comminuting elements being formed with recessed seats which are engaged by said resilient means.

* * * * *